US006510780B1

(12) United States Patent
Eden et al.

(10) Patent No.: US 6,510,780 B1
(45) Date of Patent: Jan. 28, 2003

(54) BALL SCREW DRIVEN PUMP

(75) Inventors: Bruce Eden, Bridgwater (GB); David Mantle, Bridgwater (GB); David Williams, Bridgwater (GB); Paul Britton, Hove (GB)

(73) Assignee: Lomaxmain Limited, West Sussex (GB)

( * ) Notice: Subject to any disclaimer, the term of this patent is extended or adjusted under 35 U.S.C. 154(b) by 0 days.

(21) Appl. No.: 09/857,507

(22) PCT Filed: Dec. 3, 1999

(86) PCT No.: PCT/GB99/04066

§ 371 (c)(1),
(2), (4) Date: Aug. 3, 2001

(87) PCT Pub. No.: WO00/32932

PCT Pub. Date: Jun. 8, 2000

(30) Foreign Application Priority Data

Dec. 3, 1998 (DE) ..... 9826455
Apr. 6, 1999 (DE) ..... 9907748

(51) Int. Cl.[7] ..... F04B 9/02
(52) U.S. Cl. ..... 92/136; 187/272
(58) Field of Search ..... 92/85 B, 136; 417/415; 187/272

(56) References Cited

U.S. PATENT DOCUMENTS 3,922,115 A 11/1975 Coe et al.
4,089,624 A 5/1978 Nichols et al.
4,807,724 A * 2/1989 Martin ..... 187/272
5,516,429 A 5/1996 Snodgrass et al.
6,079,797 A * 6/2000 Ganzel ..... 303/116.1

FOREIGN PATENT DOCUMENTS

DE 2219042 4/1972
DE 36 06 103 A1 8/1987

* cited by examiner

*Primary Examiner*—Edward K. Look
*Assistant Examiner*—Thomas E. Lazo
(74) *Attorney, Agent, or Firm*—Woodard, Emhardt, Naughton, Moriarty & McNett LLP

(57) ABSTRACT

A reversibly actuatable fluid hydraulic pump is described for use in a hydraulically driven elevator. The pump comprises a cylinder and a piston linearly actuatable within the cylinder by a ball screw race disposed over a spindle and connected to the piston. The shaft of the piston is hollow to receive the spindle as the piston is drawn along by virtue of the motion of the race along the spindle, and seals are provided at the free end of the piston which sealingly engage against the walls of the cylinder, and on the cylinder which sealingly engage with the shaft of the piston. A further feature of the invention is the provision of a compressible gas between the end of the cylinder and the end of the piston so that the expansion thereof reduces the work required to move the piston out of the cylinder, whereas when the system is relaxing, the compressible gas provides extra resistance and thus a smoother motion.

9 Claims, 4 Drawing Sheets

AMENDED SHEET

AMENDED SHEET

BALL SCREW DRIVEN PUMP

Figure 1:
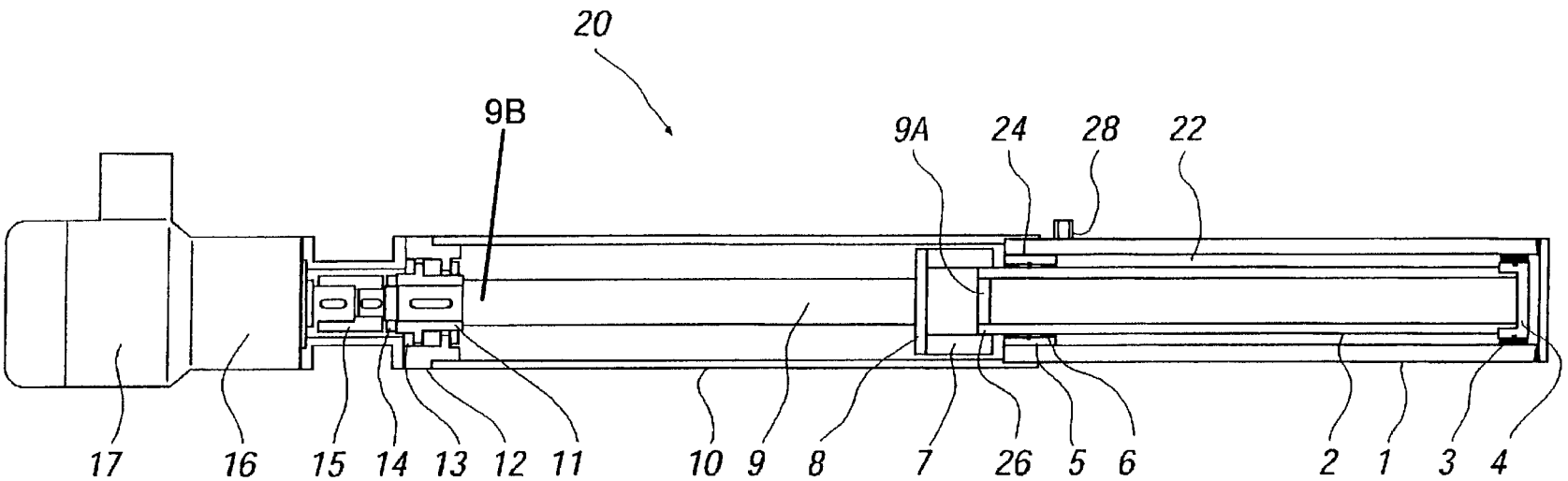

This invention relates to a fluid pump, and more particularly to a fluid pump adapted for providing a substantially uniform, and steady fluid flow rate.

Although the following description is provided in relation to the application of a fluid pump for hydraulic actuation of domestic elevators, it will be instantly appreciated from the description of the invention provided hereinafter that the invention has wide application where there is requirement for controlled pumping, steady flow during pumping of fluid, and where the hydraulic actuation to be effected by the pump in connection with an hydraulic device is such that there is displacement of the device when the pump acts in both the forward and reverse directions, the interconnection of the pump with the device being such as to form a closed system.

Furthermore, the invention has application in any mechanical action which requires a single positive movement of a prescribed volume of oil or other hydraulic fluid over a given time with a stated load, controlled by fluid movement with electric or electronic sequencing and determining of action.

Domestic elevators are currently driven by reciprocating pumps which urge oil to flow into an hydraulic cylinder which raises or lowers the elevator. The pump is usually submerged beneath an oil reservoir provided in a sealed tank. A large volume of oil is required because as described in our co-pending application of even date, the hydraulic cylinder is substantial for reasons of safety, and accordingly large in capacity. Furthermore the pressure at which the oil must be urged into the cylinder is also significant, and therefore the tank with pump provided therein is an unmanageable and weighty item.

Reciprocating pumps have a number of disadvantages. Firstly, the reciprocating actuation of the pump often introduces harmonic pulses into the fluid as it passes through the impeller of the pump. In their application to domestic elevators, this inherent drawback of reciprocating pumps restricts the particular types of fluid which can pumped therethrough to fluids which are compressible such that the harmonic pulses are damped by the fluid itself and are not transmitted through the fluid to the hydraulic cylinder to which the fluid is supplied. In other circumstances, the use of reciprocating fluid pumps is excluded for this reason. Furthermore, the harmonic pulses within the hydraulic fluid are often manifested in noise within the elevator cabin, which therefore requires soundproofing to , reduce the noise within.

Secondly, reciprocating pumps like reciprocating machinery in general are extremely noisy, and consumer distaste for noise and stringent noise limits in residential areas often necessitates that the tank with pump provided therein is located remotely from the shaft within which the elevator travels, often in a separate building whereby the noise produced can be contained.

Thirdly, the compressibility of oil necessitates a valve/venting arrangement which controls the flow rate oil into the cylinder. This is essential when it is considered that the compression of the oil within the cylinder is often significant enough to result in an appreciable increase or decrease in the height of the elevator cabin adjacent a particular floor when persons alight from or step into the cabin. Such a valve arrangement or other suitable fluid compression compensation system is commonly employed to prevent the unnecessary alarming of passengers within the elevator. The problem is further exacerbated by the fact that the compressibility characteristics of oil depend on its ambient temperature. In many cases, complex electronics is required to control a compensating mechanism which communicates with the pump motor to control the flow rate of oil into and from the cylinder to ensure that the elevation of the cabin above a certain datum level is not adversely affected by a sudden increase or decrease in the load carried by the cabin, and also to ensure that the acceleration and deceleration of the cabin proximate a floor are gradual and not rapid in order that passengers within the elevator cabin are not jolted.

Fourthly, the efficiency of reciprocating pumps is notoriously poor due to frictional losses both within the reciprocating mechanism and at the interface between the impeller of the pump and the fluid, and also because of significant heat and noise generation.

In many applications and currently in the field of domestic elevators as mentioned above, the hydraulic fluid is commonly oil. The flammability of oil presents a fire hazard, especially in domestic environments, and therefore an effectively sealed system is required to prevent leakage of oil. This increases the cost of the apparatus as a whole.

It is the object of this invention to overcome the above disadvantages and provide a pump which provides a steady flow of liquid under pressure to the apparatus to which the pump is connected.

It is a further object of the invention to provide a pump which is capable of pumping any of a number of compressible and substantially incompressible liquids without imparting harmonic pulses to the liquid during pumping thereof.

According to a first aspect of the present invention there is provided a pump for reversible hydraulic actuation of a device, said device and said pump together forming a closed hydraulic system having a fluid therein, said pump comprising a cylinder within which is disposed a piston capable of linearly translating within said cylinder, said pump further having a fluid outlet in communication with the device such that actuation of the device is effected by transfer of fluid between the pump and device when the piston is withdrawn from or urged into the cylinder, said piston being connected to one or other of a ball screw race and spindle engaging said race either of which may be rotationally driven to cause linear motion of the piston, characterised in that the fluid causing actuation of the device is retained in a cavity defined by inner walls of said cylinder, the piston shaft, a first seal between the cylinder and the piston shaft disposed towards the base of the cylinder and a second seal provided on the piston towards a free end thereof which sealingly contacts the inner cylinder walls, said fluid outlet being located on the cylinder between said seals proximate said first seal to allow for expulsion of said fluid through said outlet from said cavity when the piston is withdrawn from said cylinder.

Preferably the spindle is rotationally driven and the ball screw race is connected to the piston such that as the race translates along the spindle, the piston is translated within the cylinder.

Preferably the seals prevent fluid escaping.

In a most preferred embodiment the cylinder is charged with a compressible gas which is compressed between the piston head and the inner surface of the free end of the cylinder as the piston is driven thereinto, and which is allowed to expand as the piston is withdrawn therefrom.

This particular arrangement is advantageous in a number of different respects. Firstly, when the pump piston is in its fully inserted condition within the pump cylinder, and the pump is used in conjunction with a telescopic cylinder to force fluid into said telescopic cylinder to effect hydraulic work, the compressible gas in the pump cylinder is in a state of maximum compression because the pump piston head is almost contiguous with the inner surface of the pump cylinder free end. Hence, the compressed gas exerts a restoring force on the pump piston and aids the withdrawal of the pump piston from said pump cylinder. The "kick-start" which the pump piston is given by the compressed gas reduces the requisite power rating of the motor needed to drive the spindle or race and effect hydraulic work.

Furthermore there is no requirement for a more powerfully rated motor to put work into the compressible gas to compress same when the piston is being inserted within the cylinder because when the pump is used in conjunction with a system which in naturally relaxing, for example under gravitational effects, urges hydraulic fluid back into the pump, the extra work required to compress the compressible gas is done during the natural relaxation of the system.

Preferably the outlet communicates with a cylinder of an hydraulically actuated device, and most preferably a closed system is provided such that actuation of the hydraulic device is effected when the piston is withdrawn from or urged into the cylinder.

Most preferably the pump is provided in communication with an hydraulic cylinder for actuation of a domestic elevator.

It is yet further preferable that the hydraulic fluid used is water. Preferably the pump is vertically orientated in use to minimise gravitational effects (which may cause the spindle to whip or hunt) on the spindle as it is rotationally driven.

It will be appreciated from the foregoing that a much improved hydraulic pump is provided, because firstly the rotational motion of the motor is translated into a linear motion by the ball screw and not directly to the fluid which ensures a smooth and steady fluid flow into and from the cylinder, and secondly because the fluid is water, fluid compressibility effects are drastically reduced.

The pump of the invention has a further advantage in that the ball screw provides gives a mechanical advantage and therefore there is no requirement for the driving motor to provide a large torque to drive the spindle.

Figure 2:
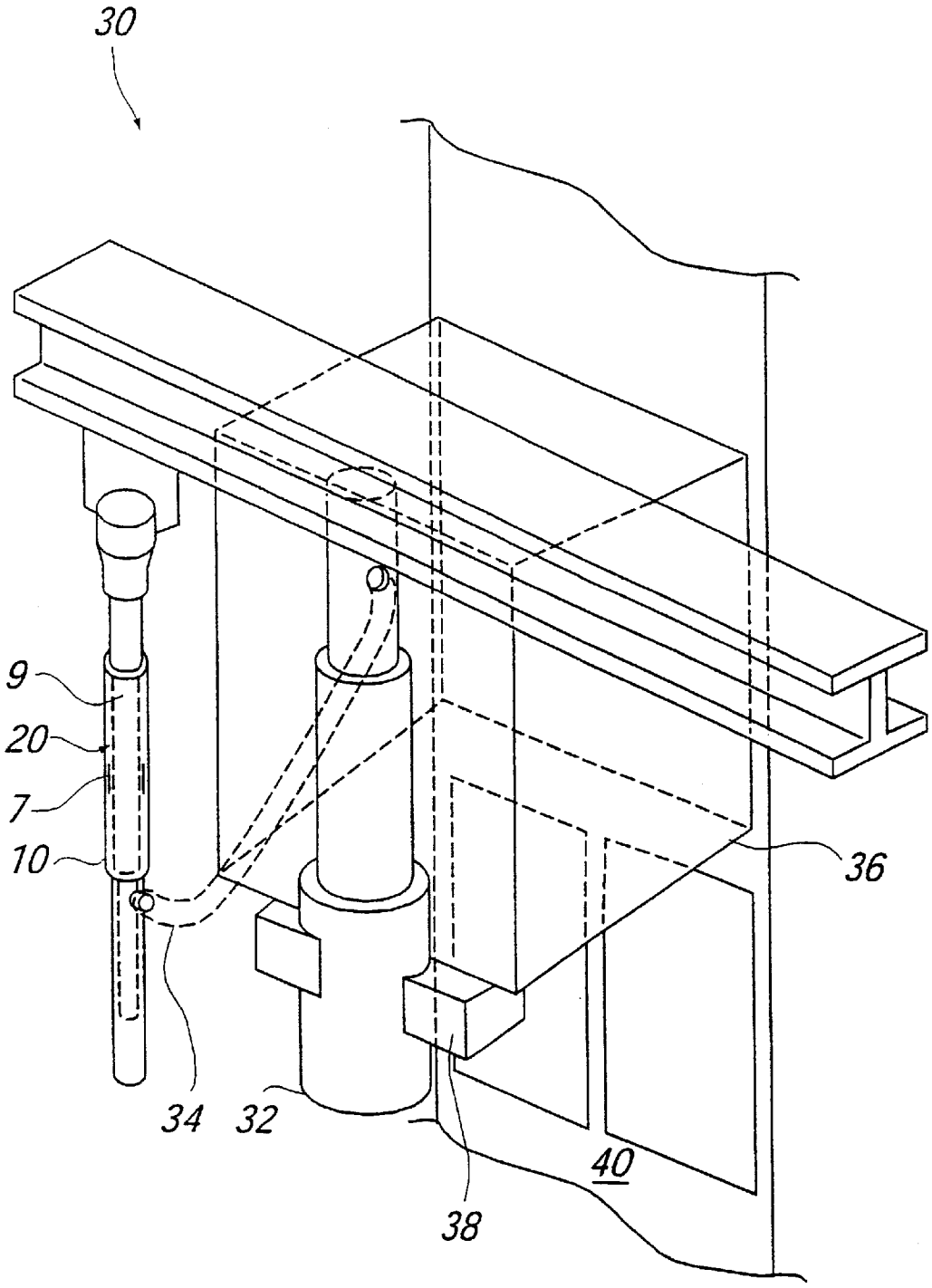
Figure 3A:
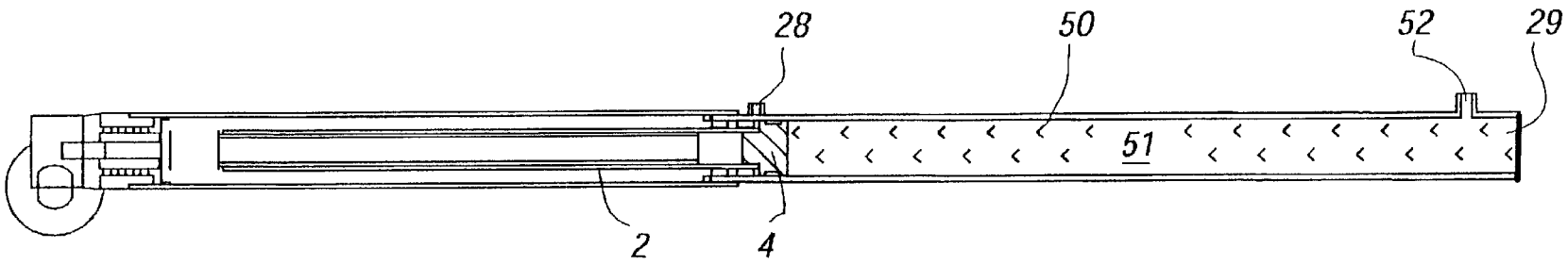
Figure 3B:
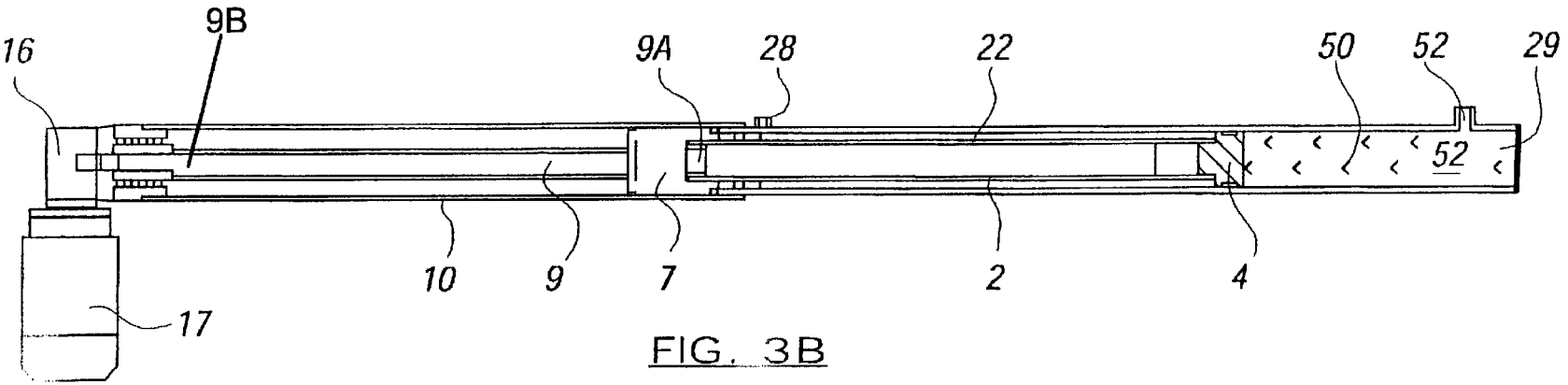
Figure 4:
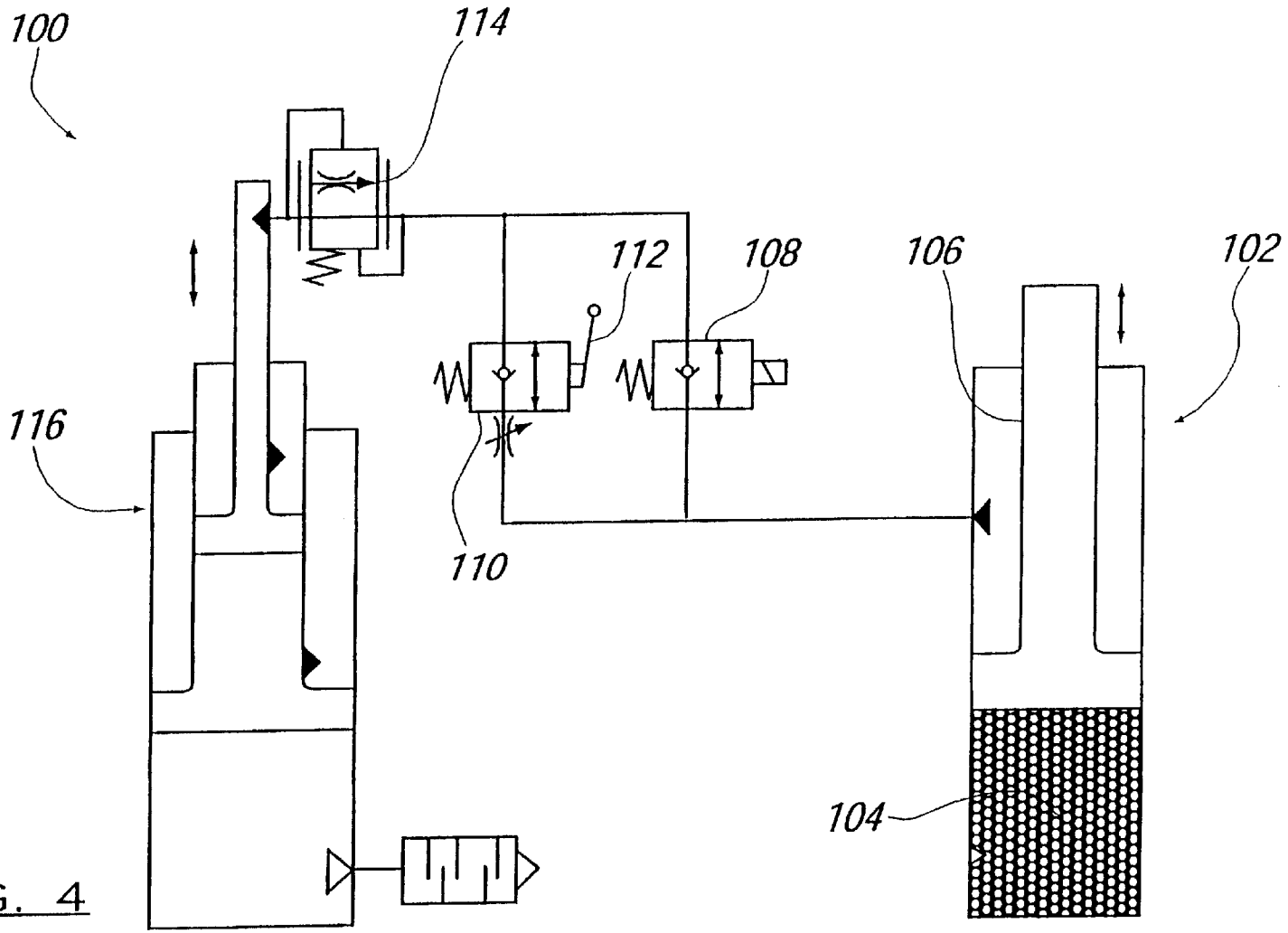

A specific embodiment of the invention will now be described by way of example with reference to the accompanying drawings in which FIG. 1 shows a sectional view of a pump according to the invention;

FIG. 2 shows the pump of FIG. 1 disposed adjacent the cylinder of an hydraulically actuated domestic elevator;

FIGS. 3*a*, 3*b* show sections of the pump according to the invention with the piston fully withdrawn from and inserted in the cylinder respectively, and FIG. 4 shows a schematic representation of a circuit diagram indicating the fluid transfer system with the pump of the invention used in conjunction with a telescopic hydraulic cylinder to actuate an elevator cabin.

Referring firstly to FIG. 1, there is shown a pump 20 according to the invention provided with an hydraulic cylinder 1 within which is disposed a hollow cylindrical piston 2 which can linearly translate within the cylinder along the axis thereof. The piston is provided at its free end with a piston head 4 which caps the piston 2 and is provided around its cylindrical surface with seals 3 which frictionally engage the inner surface of the Cylinder 1.

The cylinder 1 is additionally provided with a sealing gland 5 interferencially secured to its inner surface proximate the open end of said cylinder, and a number of annular gland seals 6 are provided in the sealing gland which contact the outer surfaces of the cylindrical piston 2. Henceforth the gland seals 6, the outer surface of the piston 2, the inner surface of the cylinder 1 and the piston seals 3 define an annular cavity 22 within which is disposed an hydraulic fluid, which is preferably water.

At the alternate end of the piston the piston head 4 and externally of the cylinder 1 behind the sealing gland 5 there is provided a guide tube 10 which is rigidly secured to the outer surface of the cylinder in a region 24. A ball screw race 7 and a spindle 9 are disposed within the guide tube 10, the race 7 being securely connected to the outer surface of the piston in a region 26.

The spindle 9 has a free end 9A and an alternate end 9B which is disposed within a bearing sleeve 11 in turn mounted in a bearing housing 12 inserted in the end of the guide tube opposite that to which the cylinder is connected. A bearing set 13 (Specification 61910-RS1, 61911-RS1, 81210) is also provided between the bearing sleeve and the bearing housing, and this assembly is connected to a brake motor (rated as 750 W 3-Phase 4-pole) at a coupling 15 through a gearbox 16 which reduces the rotational speed of the motor to an acceptable level and increases the torque transmitted by said motor to the spindle 9.

In use the brake motor 17 rotationally drives the spindle 9 in clockwise and anticlockwise directions such that the ball screw race 7 linearly translates along said spindle within the guide tube 10. This linear motion is transferred to the piston 2 connected, to the race, and henceforth fluid is either expressed from or drawn into the cavity 22 through a nozzle 28 provided in the outer surface of the cylinder 1 and which communicates with the said cavity 22. The use of a ball screw ensures smooth fluid flow to and from the cylinder which is of great advantage in the circumstance where the pump is used to actuate the hydraulic cylinder of a domestic elevator.

Such a domestic elevator is shown schematically in FIG. 2 and indicated generally at 30. The cylinder configuration disclosed herein forms the substance of our copending application of even date.

The pump 20 is disposed substantially parallel with and adjacent a hydraulic cylinder 32 to minimise the gravitational effects on the rotation of the spindle 9 within the guide tube 10. It is to be mentioned that the disproportionate sizes of the pump 20 and the cylinder 32 in FIG. 2 are irrelevant, the FIG. providing only a schematic representation of the desired configuration.

A fluid hose 34 links the cylinder 32 with the pump 20 and it will be seen that a closed fluid system is formed such that any motion of the piston within the pump will effect a corresponding motion of the cylinder 32, and ultimately an elevator cabin 36 which is supported by the cylinder 32 by support means 38 within an elevator shaft 40. It is to be further mentioned that the pump and the cylinder may be disposed in almost contiguous relationship because in use, all external surfaces of the pump remain motionless. Henceforth it may be possible to provide a housing within which both the pump and the cylinder may be disposed thus minimising the space requirement of the pump/cylinder configuration, and reducing the length of the interconnecting fluid hose 34 which is required to connect the said pump and cylinder.

Referring to FIGS. 3*a*, 3*b*, the advantages of providing a compressible fluid 50 in the variable volume cavity 51 defined by the inner surface of the free end of the cylinder 29 and the piston head 4 will be instantly realised. The power required of the motor 17 to drive the piston 2 into the cylinder 1 is not increased by the provision of the compressible fluid 50 because in the arrangement shown in FIG. 2, the back pressure provided by the weight of the elevator cabin naturally aids the drawing back into the cylinder of the hydraulic fluid, and also, the power required of the motor 17 to withdraw the piston 2 from the cylinder 1 and urge the hydraulic fluid from said cylinder into the elevator cabin actuation means is reduced because the compressible fluid, being compressed as shown in FIG. 3*b* aids the withdrawal of the piston 2 from said cylinder 1 by exerting hydrostatic pressure on the piston head 4. A compressible, inert gas such as Nitrogen would be suitable as a compressible fluid. Initial charging pressure may be in the region of 12 bar (1.6 Mpa) which would provide a "kick-start" force of 180 kgf (1764 N).

A further advantage of providing the compressible fluid in the pump cylinder as described is that the operating velocity of both the pump and the hydraulically actuated apparatus to which it is connected can be attained quicker.

Ideally, the charging of the cylinder with the compressible fluid is effected through a one-way, single operation valve 52, e.g. a eutectic valve.

Referring finally to FIG. 4, there is shown a fluid transfer system 100 comprising a fluid transfer unit 102 of the type described above having a compressible fluid 104 provided therein to aid expulsion of hydraulic fluid 106 also provided therein. The hydraulic fluid 106 passes through a stop valve 108 and/or optionally an emergency lowering valve 110 which may be manually operated with a lever 112. The fluid then passes through a pressure compensated fixed flow control valve 114 and into a telescopic pulling cylinder 116 of the type described both above and in more detail in our co-pending patent application No. GB9826452.6.

What is claimed is:

1. A pump (20) for reversible hydraulic actuation of a device (36), said device and said pump together forming a closed hydraulic system having a fluid therein, said pump comprising a cylinder (1) within which is disposed a piston (2) capable of linearly translating within said cylinder, said pump further having a fluid outlet (28) in communication with the device such that actuation of the device is effected by transfer of fluid between the pump and device when the piston is withdrawn from or urged into the cylinder, said piston being connected to one or other of a ball screw race (7) and spindle (9) engaging said race either of which may be rotationally driven to cause linear motion of the piston, characterised in that the fluid causing actuation of the device is retained in a cavity (22) defined by inner walls of said cylinder, the piston shaft, a first seal (5, 6) between the cylinder and the piston shaft disposed towards the base of the cylinder and a second seal (3) provided on the piston towards a free end (4) thereof which sealingly contacts the inner cylinder walls, said fluid outlet being located on the cylinder between said seals proximate said first seal to allow for expulsion of said fluid through said outlet from said cavity when the piston is withdrawn from said cylinder.

2. A pump according to claim 1 characterised in that the spindle (9) is rotationally driven and the ball screw race (7) is connected to the piston (2) such that as the race translates along the spindle, the piston is translated within the cylinder (1).

3. A pump according to claim 1 characterised in that one or other of the piston shaft (2) and spindle (9) are hollow to receive the alternate component during axial relative movement of said spindle and piston shaft.

4. A pump according to claim 3 characterised in that the piston shaft (2) receives the spindle (9) therein as it moves within the cylinder.

5. A pump according to claim 1 characterised in that there are two fluids within the cylinder (1) but in different compartments (22,51) thereof sealed off from one another, one of said fluids being substantially incompressible and being expelled from said cylinder to cause reversible actuation of the device to which the pump is attached by virtue of the piston (2) motion in a forward direction, the second fluid (50) being pressurised and substantially compressible such that compression thereof occurs as the incompressible fluid fills the cylinder by virtue of the reverse movement of the piston, the overall effect being a counterbalancing one.

6. A pump according to claim 5 characterised in that the piston head (4) sealingly contacts the cylinder walls partially defining both compartments (22, 51) such that the volume of the compartments changes as the piston moves within the cylinder.

7. A pump according to claim 1 characterised in that the pump is provided in communication with an hydraulic cylinder (32) coupled to the device (36).

8. A pump according to claim 1 characterised in that the hydraulic fluid used is water.

9. A pump according to claim 1 characterised in that the pump is vertically orientated in use to minimise gravitational effects on the spindle (9) as it is rotationally drive.

* * * * *